US007924133B2

(12) United States Patent
Kaneko

(10) Patent No.: US 7,924,133 B2
(45) Date of Patent: Apr. 12, 2011

(54) BOBBIN FOR COIL, COIL WINDING, AND COIL COMPONENT

(75) Inventor: Kouji Kaneko, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/536,985

(22) Filed: Aug. 6, 2009

(65) Prior Publication Data

US 2010/0039207 A1 Feb. 18, 2010

(30) Foreign Application Priority Data

Aug. 12, 2008 (JP) ..... P2008-208097

(51) Int. Cl.
*H01F 5/00* (2006.01)
*H01F 27/30* (2006.01)
*H01F 27/24* (2006.01)

(52) U.S. Cl. ..... 336/200; 336/198; 336/212

(58) Field of Classification Search ..... None
See application file for complete search history.

(56) References Cited

U.S. PATENT DOCUMENTS

| | | | | |
|---|---|---|---|---|
| 4,583,068 | A * | 4/1986 | Dickens et al. | 336/82 |
| 5,010,314 | A * | 4/1991 | Estrov | 336/198 |
| 6,002,319 | A | 12/1999 | Honma | |
| 7,408,436 | B2 * | 8/2008 | Ikezawa | 336/208 |
| 7,717,687 | B2 * | 5/2010 | Reinhart | 418/55.5 |
| 2005/0068149 | A1 * | 3/2005 | Fushimi | 336/208 |

FOREIGN PATENT DOCUMENTS

| | | |
|---|---|---|
| EP | 0 918 342 A1 | 5/1999 |
| JP | U-52-22550 | 2/1977 |
| JP | A-5-166646 | 7/1993 |
| JP | A-6-151207 | 5/1994 |
| JP | A-9-246063 | 9/1997 |
| JP | A-2000-164430 | 6/2000 |
| JP | A-2002-246240 | 8/2002 |
| JP | A-2004-303864 | 10/2004 |
| JP | A-2005-217311 | 8/2005 |

OTHER PUBLICATIONS

English Translation of Japanese Office Action for Japanese Patent Application No. P2008-208097, dated Jul. 6, 2010.

* cited by examiner

*Primary Examiner* — Anh T Mai
(74) *Attorney, Agent, or Firm* — Oliff & Berridge, PLC

(57) ABSTRACT

A coil bobbin has a cylindrical portion around which a coil winding is wound. The coil winding is composed of coil members of an end-defined ring shape coupled to each other. The cylindrical portion is inserted into openings of the coil members along a direction of a center axis of the cylindrical portion and from one end of the cylindrical portion. Flanges protruding outwardly relative to the center axis of the cylindrical portion are integrally provided at the other end of the cylindrical portion and a bobbin-side engagement portion for engagement between the coil bobbin and the coil winding is formed on a face of the flange opposed to the coil member. As the cylindrical portion is inserted into the coil members, the bobbin-side engagement portion comes into engagement with a winding-side engagement portion formed on a back face of the coil member.

7 Claims, 11 Drawing Sheets

BOBBIN FOR COIL, COIL WINDING, AND COIL COMPONENT

BACKGROUND OF THE INVENTION

1. Field of the Invention

The present invention relates to a bobbin for coil, a coil winding, and a coil component.

2. Related Background Art

As a component mounted on an automobile, there is a known DC-DC converter for converting a high voltage into a low voltage or for converting a low voltage into a high voltage. The DC-DC converter is equipped with a coil component and a known coil component to be mounted on the DC-DC converter is the one described in Japanese Patent Application Laid-open No. 2005-217311. The coil component described in Laid-open No. 2005-217311 is provided with a coil winding and an electrically insulating bobbin for coil (which will be referred to hereinafter as a coil bobbin) of a cylindrical shape, and the coil bobbin is inserted into the inside of the coil winding as shown in FIG. 2.

SUMMARY OF THE INVENTION

In the above-described conventional coil component, however, the coil bobbin is allowed to rotate relative to the coil winding in a state in which the coil bobbin is inserted in the coil winding. For this reason, there is unsteadiness between the coil bobbin and the coil winding and thus there is still room for improvement in this respect.

An object of the present invention is therefore to provide a coil bobbin, a coil winding, and a coil component capable of reducing the unsteadiness between the coil bobbin and the coil winding.

A coil bobbin according to the present invention is an electrically insulating coil bobbin comprising a cylindrical portion around which an electrically conductive coil winding is to be wound, wherein the coil winding is comprised of a plurality of coil members of an end-defined ring shape coupled so as to be continuous in a predetermined winding direction, wherein the cylindrical portion is to be inserted into openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion to be opposed to the coil member, and wherein the bobbin-side engagement portion is to come into engagement with a winding-side engagement portion formed on a face to be opposed to the insulating portion, of the coil member into which the cylindrical portion is first to be inserted.

In this coil bobbin, the cylindrical portion thereof is inserted into the openings of the coil members from its one end. With the insertion, the face of the insulating portion provided at the other end of the cylindrical portion becomes closer to the face of the coil member into which the cylindrical portion is first inserted. With further insertion, the bobbin-side engagement portion formed on the face of the insulating portion comes into engagement with the winding-side engagement portion formed on the face of the coil member into which the cylindrical portion is first inserted. This engagement suppresses rotation of the coil bobbin and thus reduces the unsteadiness between the coil bobbin and the coil winding.

Preferably, a projection protruding outwardly relative to the center axis is provided on an outer peripheral surface between the one end and the other end of the cylindrical portion; the coil member into which the cylindrical portion is first to be inserted, has a projection insertion portion extending from an inner periphery to an outer periphery thereof; the cylindrical portion is to be inserted into the openings of the coil members so that the projection passes through the projection insertion portion; and, after the insertion of the cylindrical portion, the cylindrical portion is to be rotated relative to the coil winding whereby the projection is located between the coil members and whereby the bobbin-side engagement portion comes into engagement with the winding-side engagement portion. In this case, as the cylindrical portion is rotated relative to the coil winding with the projection through the projection insertion portion, the projection can be brought into the space between the coil members. Since the projection interposed between the coil members suppresses movement of the coil bobbin in the center axis direction, it can further reduce the unsteadiness between the coil bobbin and the coil winding. Since the projection interposed between the coil members prevents contact between the coil members, it can prevent the coil members from contacting each other to short-circuit.

Preferably, the bobbin-side engagement portion is a projection and the winding-side engagement portion is a depression or a through hole. In this case, the bobbin-side engagement portion of the projection is fitted in the winding-side engagement portion of the depression or through hole, which can securely reduce the unsteadiness between the coil bobbin and the coil winding.

Preferably, the bobbin-side engagement portion is a depression or a through hole and the winding-side engagement portion is a projection. In this case, the winding-side engagement portion of the projection is fitted in the bobbin-side engagement portion of the depression or through hole, which can securely reduce the unsteadiness between the coil bobbin and the coil winding.

Preferably, the coil bobbin is to be sandwiched between magnetic core members in the direction of the center axis, and a leg for engaging the coil bobbin with the magnetic core member is provided in a projecting state on a face of the insulating portion opposite to the face to be opposed to the coil member. In this case, the coil bobbin can be positioned relative to the magnetic core members by engaging the leg with the magnetic core member. Therefore, it is feasible to suppress unsteadiness of the coil bobbin relative to the magnetic core members.

A coil winding according to the present invention is an electrically conductive coil winding to be wound around a cylindrical portion of an electrically insulating coil bobbin, wherein the coil winding is comprised of a plurality of coil members of an end-defined ring shape coupled so as to be continuous in a predetermined winding direction, wherein the cylindrical portion is to be inserted into openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion to be opposed to the coil member, and wherein a winding-side engagement portion engageable with the bobbin-side engagement portion is formed on a face to be opposed to the insulating portion, of the coil member into which the cylindrical portion is first to be inserted.

In this coil winding, the cylindrical portion of the coil bobbin is inserted into the openings of the coil members. With progress of insertion, the face of the insulating portion provided at the other end of the cylindrical portion becomes closer to the face of the coil member into which the cylindrical portion is first inserted. Then the bobbin-side engagement portion formed on the face of the insulating portion comes into engagement with the winding-side engagement portion formed on the face of the coil member. This engagement suppresses rotation of the coil bobbin and thus reduces the unsteadiness between the coil bobbin and the coil winding.

Preferably, a projection protruding outwardly relative to the center axis is provided on an outer peripheral surface between the one end and the other end of the cylindrical portion; the coil member into which the cylindrical portion is first to be inserted, has a projection insertion portion extending from an inner periphery to an outer periphery thereof; the projection is made to pass through the projection insertion portion during insertion of the cylindrical portion into the openings of the coil members; and, after the insertion of the cylindrical portion, the cylindrical portion is to be rotated relative to the coil winding whereby the projection is located between the coil members and whereby the winding-side engagement portion comes into engagement with the bobbin-side engagement portion. In this case, the cylindrical portion is rotated relative to the coil winding with the projection trough the projection insertion portion, whereby the projection is brought into the space between the coil members. The projection interposed between the coil members suppresses movement of the coil bobbin in the center axis direction, which can further reduce the unsteadiness between the coil bobbin and the coil winding. The projection interposed between the coil members prevents contact between the coil members, and thus prevents the coil members from contacting each other to short-circuit.

Preferably, the bobbin-side engagement portion is a projection and the winding-side engagement portion is a depression or a through hole. In this case, the bobbin-side engagement portion of the projection is fitted in the winding-side engagement portion of the depression or through hole, which can securely reduce the unsteadiness between the coil bobbin and the coil winding.

Preferably, the bobbin-side engagement portion is a depression or a through hole and the winding-side engagement portion is a projection. In this case, the winding-side engagement portion of the projection is fitted in the bobbin-side engagement portion of the depression or through hole, which can securely reduce the unsteadiness between the coil bobbin and the coil winding.

Preferably, a projecting portion is provided on a face opposite to the face to be opposed to the insulating portion, of the coil member into which the cylindrical portion is first to be inserted, and the projecting portion is located at the other end of the coil member. In this case, if the cylindrical portion is rotated in a direction from the projection insertion portion (slit) to the other end of the coil member, the projection of the coil bobbin is caught by the projecting portion protruding from the front face of the coil member, to hinder further rotation of the cylindrical portion. Therefore, the rotational direction of the coil bobbin is uniquely determined and thus the coil bobbin and the coil winding can be securely and correctly coupled.

A coil component according to the present invention is a coil component comprising an electrically insulating coil bobbin having a cylindrical portion, and an electrically conductive coil winding wound around the cylindrical portion, wherein the coil winding is comprised of a plurality of coil members of an end-defined ring shape coupled so as to be continuous in a predetermined winding direction, wherein the cylindrical portion is inserted in openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion opposed to the coil member, and wherein a winding-side engagement portion engageable with the bobbin-side engagement portion is formed on a face opposed to the insulating portion, of the coil member into which the cylindrical portion is first to be inserted.

In this coil component, the cylindrical portion of the coil bobbin is inserted into the openings of the coil members from its one end. With the insertion, the face of the insulating portion provided at the other end of the cylindrical portion becomes closer to the face of the coil member to which the cylindrical portion is first inserted. With further insertion, the bobbin-side engagement portion formed on the face of the insulating portion comes into engagement with the winding-side engagement portion formed on the face of the coil member into which the cylindrical portion is first inserted. This suppresses rotation of the coil bobbin and thus reduces the unsteadiness between the coil bobbin and the coil winding.

Preferably, a projection protruding outwardly relative to the center axis is provided on an outer peripheral surface between the one end and the other end of the cylindrical portion; the coil member into which the cylindrical portion is first to be inserted, has a projection insertion portion extending from an inner periphery to an outer periphery thereof; the cylindrical portion is to be inserted into the openings of the coil members so that the projection passes through the projection insertion portion; and, after the insertion of the cylindrical portion, the cylindrical portion is to be rotated relative to the coil winding whereby the projection is located between the coil members and whereby the bobbin-side engagement portion comes into engagement with the winding-side engagement portion. In this case, the cylindrical portion is rotated relative to the coil winding with the projection through the projection insertion portion, whereby the projection is brought into the space between the coil members. The projection interposed between the coil members suppresses movement of the coil bobbin in the center axis direction, which can further reduce the unsteadiness between the coil bobbin and the coil winding. The projection interposed between the coil members prevents contact between the coil members and thus prevents the coil members from contacting each other to short-circuit.

Preferably, the bobbin-side engagement portion is a projection and the winding-side engagement portion is a depression or a through hole. In this case, the bobbin-side engagement portion of the projection is fitted in the winding-side engagement portion of the depression or through hole, which can securely reduce the unsteadiness between the coil bobbin and the coil winding.

Preferably, the bobbin-side engagement portion is a depression or a through hole and the winding-side engagement portion is a projection. In this case, the winding-side engagement portion of the projection is fitted in the bobbin-side engagement portion of the depression or through hole, which can securely reduce the unsteadiness between the coil bobbin and the coil winding.

Preferably, a projecting portion is provided on a face opposite to the face opposed to the insulating portion, of the coil member into which the cylindrical portion is first to be inserted, and the projecting portion is located at the other end of the coil member. In this case, if the cylindrical portion is rotated in a direction from the projection insertion portion (slit) to the other end of the coil member, the projection of the coil bobbin is caught by the projecting portion protruding from the front face of the coil member, to hinder further rotation of the cylindrical portion. Therefore, the rotational direction of the coil bobbin is uniquely determined and thus the coil bobbin and the coil winding can be securely and correctly coupled.

Preferably, the coil bobbin is sandwiched between magnetic core members in the direction of the center axis, and a leg for engaging the coil bobbin with the magnetic core member is provided in a projecting state on a face of the insulating portion opposite to the face opposed to the coil member. In this case, the coil bobbin can be positioned relative to the magnetic core members by engaging the leg with the magnetic core member. Therefore, it is feasible to suppress unsteadiness of the coil bobbin relative to the magnetic core members.

The coil component preferably further comprises the magnetic core members. In this case, we can obtain the coil component wherein the coil bobbin and the coil winding with reduced unsteadiness are interposed between the pair of magnetic core members.

A transformer according to the present invention comprises the above-described coil component. In this case, we can obtain the transformer with reduced unsteadiness between the coil bobbin and the coil winding.

A DC-DC converter according to the present invention comprises the aforementioned transformer. In this case, we can obtain the DC-DC converter with reduced unsteadiness between the coil bobbin and the coil winding.

A DC-DC converter according to the present invention comprises the aforementioned coil component. We can obtain the DC-DC converter with reduced unsteadiness between the coil bobbin and the coil winding.

The present invention successfully provides the coil bobbin, coil winding, and coil component with reduced unsteadiness between the coil bobbin and the coil winding.

DESCRIPTION OF THE PREFERRED EMBODIMENTS

The preferred embodiments of the present invention will be described below in detail with reference to the drawings.

First Embodiment

Figure 1:
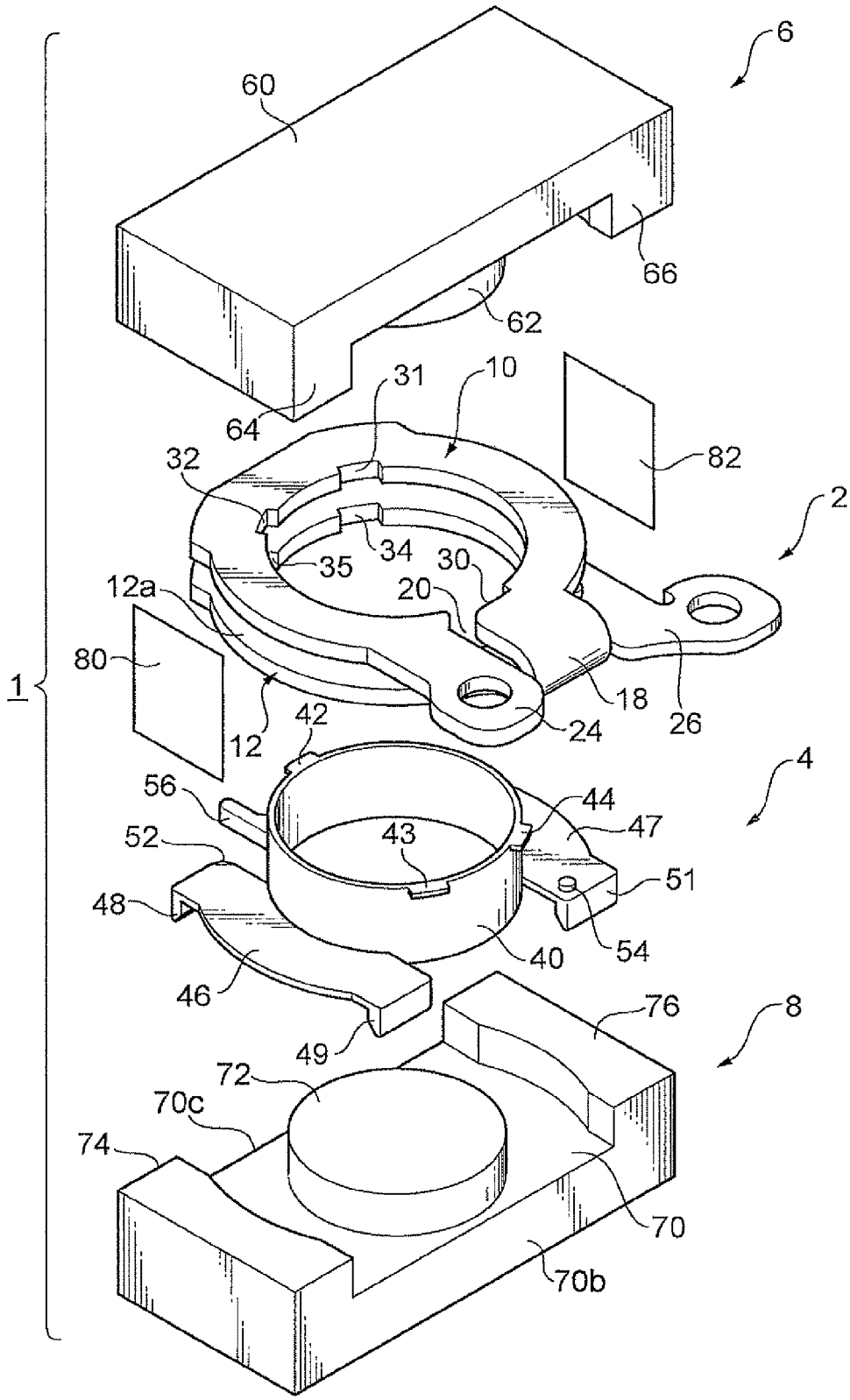
FIG. 1 is an exploded perspective view showing an embodiment of the coil component according to the present invention.
Figure 2A:
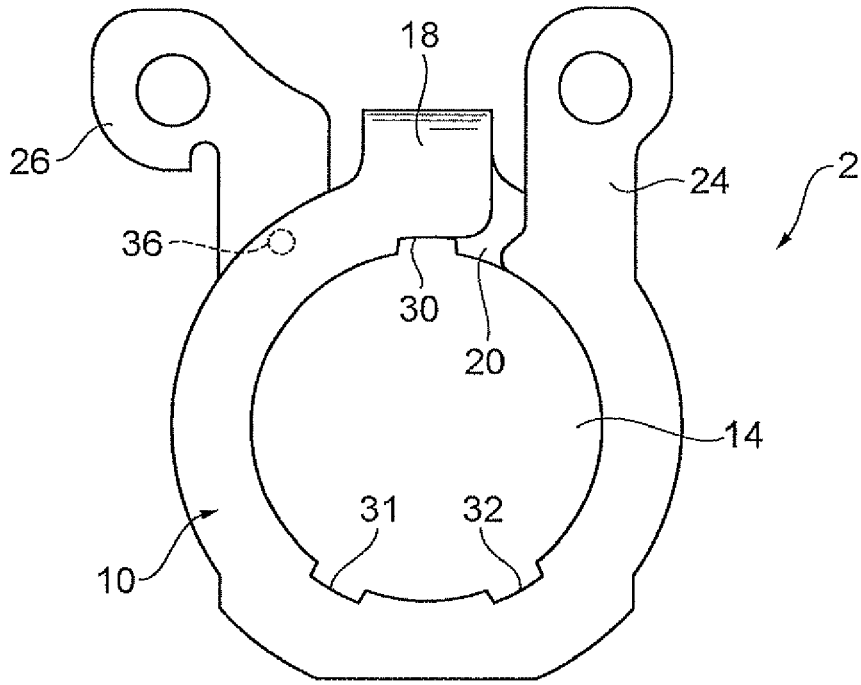
FIG. 2A is a plan view of a coil winding in the coil component of FIG. 1.

A configuration of a coil component according to the present embodiment will be described with reference to FIGS. 1 to 3. FIG. 1 is an exploded perspective view showing the coil component according to the present embodiment. FIG. 2A is a plan view of a coil winding in the coil component of FIG. 1, FIG. 2B a bottom view of the coil winding in the coil component of FIG. 1, and FIG. 3 a side view of the coil winding in the coil component of FIG. 1. FIG. 4A is a plan view of a coil bobbin in the coil component of FIG. 1 and FIG. 4B a bottom view of the coil bobbin in the coil component of FIG. 1.

The coil component 1 shown in FIG. 1 is used, for example, in an inductance element, a switching power unit, a noise filter, an inverter, and so on. The coil component 1 has a coil winding 2, a coil bobbin 4 around which the coil winding 2 is wound, and a pair of core members (magnetic core members) 6, 8.

The coil winding 2 is one in which first and second coil members 10, 12 of an end-defined ring shape juxtaposed with a space between them are coupled so as to be continuous in a predetermined winding direction.

Figure 2B:
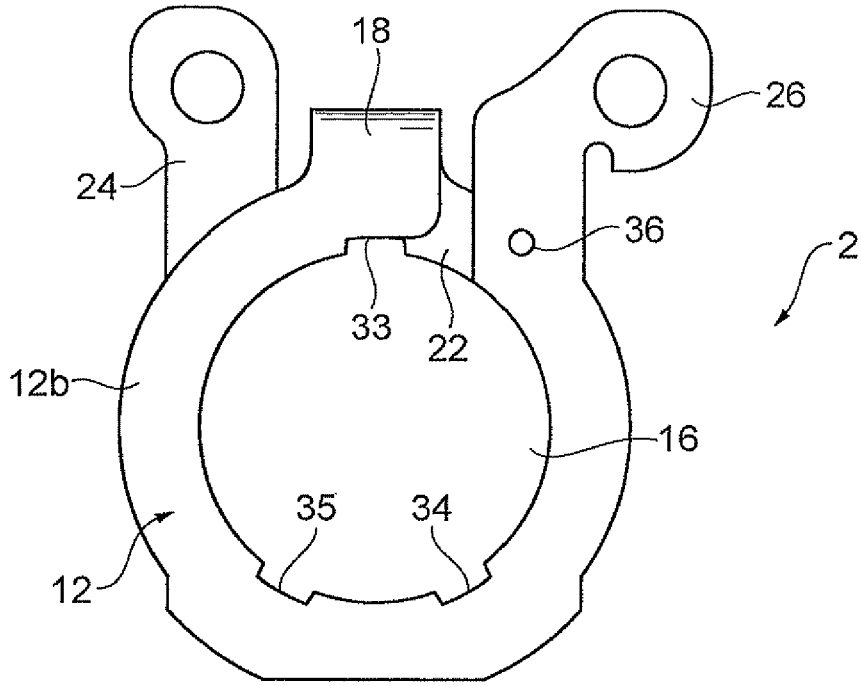
FIG. 2B is a bottom view of a coil winding in the coil component of FIG. 1.

As shown in FIG. 2A and FIG. 2B, the first and second coil members 10, 12 of the end-defined ring shape are of a so-called C-shape and have circular openings 14, 16 in their center. There are slits 20, 22 extending from the inner periphery to the outer periphery, between one end and the other end of the first and second coil members 10, 12. The first coil member 10 and the second coil member 12 overlap each other so that the openings 14, 16 communicate with each other. The first coil member 10 and the second coil member 12 overlap each other in a state in which the positions of the slit 20 and slit (projection insertion portion) 22 deviate from each other (i.e., so that they do not communicate with each other). For this reason, the other end of the first coil member 10 overlaps one end of the second coil member 12.

A first terminal portion 24 protruding outwardly relative to a direction of a center axis of the opening 14 is provided integrally with the one end of the first coil member 10 and the other end of the first coil member 10 is coupled through a U-shaped joint 18 to the one end of the second coil member 12. A second terminal portion 26 protruding outwardly relative to the direction of the center axis of the opening 16 is provided integrally with the other end of the second coil member 12.

In the coil winding 2 of this configuration, the first terminal portion 24 is a leading end of the coil winding 2 and the second terminal portion 26 is a trailing end of the coil winding 2. Electricity fed to the first terminal portion 24 flows in an order of the first coil member 10, the joint 18, and the second coil member 12 to be output from the second terminal portion 26.

A plurality of (three in the present embodiment) indentations 30, 31, and 32 indented outwardly are formed in the inner periphery of the first coil member 10. The indentations 30-32 are arranged in a state in which they are separated from each other along the circumferential direction of the opening 14. When viewed from the direction of the center axis of the opening 14, an angle between a line connecting the center axis of the opening 14 and the indentation 30 and a line connecting the center axis of the opening 14 and the indentation 31 is approximately 150°; an angle between the line connecting the center axis of the opening 14 and the indentation 30 and a line connecting the center axis of the opening 14 and the indentation 32 is approximately 150°; an angle between the line connecting the center axis of the opening 14 and the indentation 31 and the line connecting the center axis of the opening 14 and the indentation 32 is approximately 60°.

A plurality of (three in the present embodiment) indentations 33, 34, and 35 indented outwardly are formed in the inner periphery of the second coil member 12. The indentations 33-35 are arranged in a state in which they are separated from each other along the circumferential direction of the opening 16. When viewed from the direction of the center axis of the opening 16, an angle between a line connecting the center axis of the opening 16 and the indentation 33 and a line connecting the center axis of the opening 16 and the indentation 34 is approximately 150°; an angle between the line connecting the center axis of the opening 16 and the indentation 33 and a line connecting the center axis of the opening 16 and the indentation 35 is approximately 150°; an angle between the line connecting the center axis of the opening 16 and the indentation 34 and the line connecting the center axis of the opening 16 and the indentation 35 is approximately 60°. Namely, the indentations 33-35 of the second coil member 12 coincide in position with the indentations 30-32 of the first coil member 10.

The indentations 30-35 penetrate in the thickness direction of the first and second coil members 10, 12. When viewed from the center axis direction of the openings 14, 16, the indentations 30-35 have a predetermined width along the circumference of the openings 14, 16 and a predetermined depth in a radial direction of the openings 14, 16. When viewed from the center axis direction of the openings 14, 16, the indentations 30, 33 extend in parallel with the slit 22 of the second coil member 12.

Incidentally, it is considered that when the indentations 30-35 are so formed, the first and second coil members 10, 12 become narrower around the indentations 30-35, so as to increase electric resistance there. Since the increase in electric resistance can cause heat generation or the like, it is necessary to avoid it. In the present embodiment, therefore, the indentation 30 is formed at the other end of the first coil member 10 integrated with the U-shaped joint 18 and, similarly, the indentation 33 is formed at the one end of the second coil member 12 integrated with the joint 18, thereby securing the width (cross-sectional area) of the first and second coil members 10, 12 in the regions where the indentations 30, 33 are formed. Furthermore, the first and second coil members 10, 12 are widened in part and the indentations 31, 32, 34, 35 are formed in the widened regions, thereby securing the width of the first and second coil members 10, 12 in the regions where the indentations 31, 32, 34, 35 are formed. In the present embodiment, as described above, the widths of the first and second coil members 10, 12 are secured in the formed regions of the indentations 30-35, so as to suppress the increase in electrical resistance due to decrease in the cross-sectional area of each coil member 10, 12 determined by width and thickness.

Figure 3:
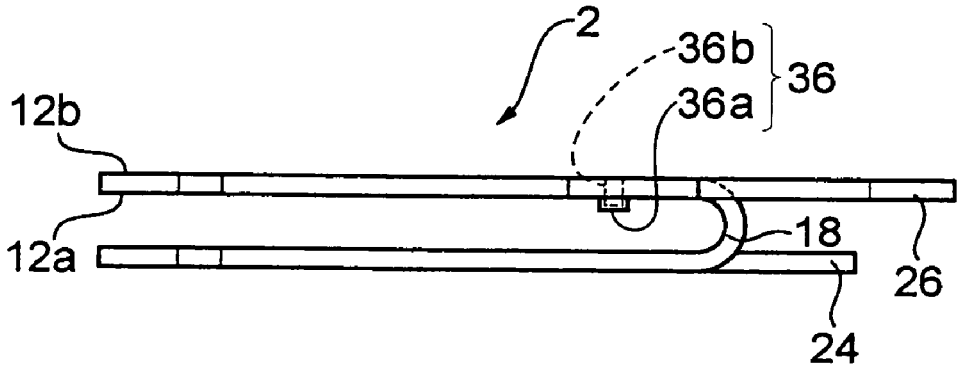
FIG. 3 is a side view of the coil winding in the coil component of FIG. 1.
Figure 4A:
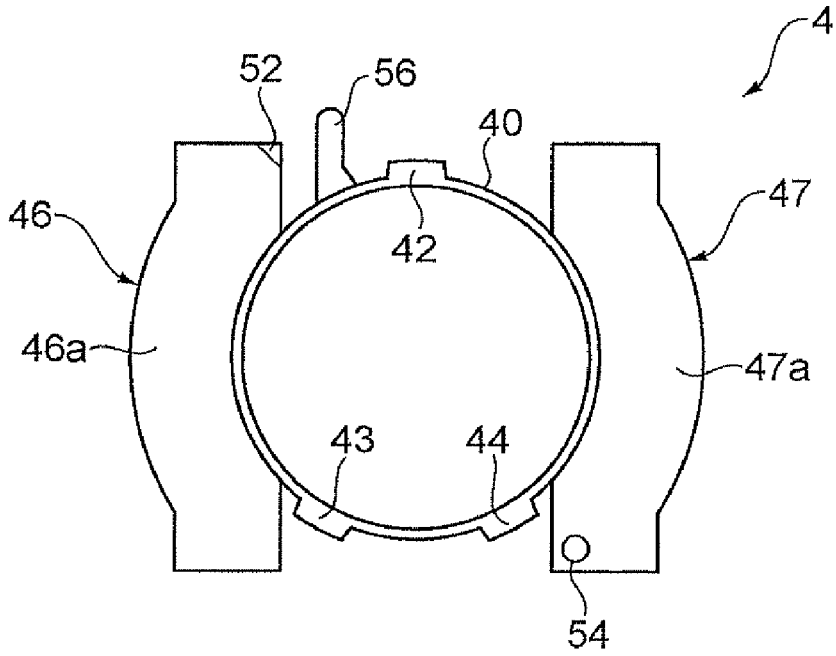
FIG. 4A is a plan view of a coil bobbin in the coil component of FIG. 1.

As shown in FIG. 2B and FIG. 3, a winding-side engagement portion 36 for engagement between coil winding 2 and later-described coil bobbin 4 is provided at the other end of the second coil member 12. The winding-side engagement portion 36 is of a cylindrical shape closed at one end and opened at the other end, and protrudes from a front face 12*a* opposed to the first coil member 10, toward the first coil member 10. Furthermore, the winding-side engagement portion 36 is opened in a back face 12*b* located opposite to the front face 12*a* and for this reason, it is depressed when viewed from the back face 12*b* side. Namely, the winding-side engagement portion 36 is a depression 36*b* when viewed from the back face 12*b* side and a projection 36*a* when viewed from the front face 12*a* side.

The coil winding 2 of the above-described configuration can be formed by punching a single substrate with high electrical conduction. More specifically, a substrate such as a copper plate or an aluminum plate is punched to obtain the first terminal portion 24, the first coil member 10 continuous to the first terminal portion 24, the second coil member 12, the second terminal portion 26 continuous to the second coil member 12, and the I-shaped joint 18 coupling the first and second coil members 10, 12. Then the joint 18 is bent in a U-shape to make the first coil member 10 and the second coil member 12 overlap each other. This completes the coil winding 2. The coil winding 2 does not have to be limited to the folded coil as described above, but may be one obtained by screwing or welding two coil windings or, the coil members and the joint. They may be secured by rivets.

As shown in FIG. 1, the coil winding 2 is wound around a cylindrical portion 40 of the coil bobbin 4 made of an electrically insulating material. The cylindrical portion 40 of the coil bobbin 4 is of a cylindrical shape opened at both ends and a center axis of the cylindrical portion 40 agrees with the center axis of the openings 14, 16 of the first and second coil members 10, 12. The outside diameter of the cylindrical portion 40 is so defined that the cylindrical portion 40 can slide relative to the openings 14, 16 of the first and second coil members 10, 12, and the length of the cylindrical portion 40 is so defined that the two ends of the cylindrical portion 40 can protrude from the coil winding 2.

A plurality of (three in the present embodiment) claws 42, 43, and 44 for preventing contact between the coil winding and the core member 6 are provided in a protruding state at one end of the cylindrical portion 40. The claws 42-44 protrude from the outer periphery of the cylindrical portion 40 in directions perpendicular to the center axis of the cylindrical portion 40 and are integrated with the cylindrical portion 40. The claws 42-44 are arranged as separated from each other in the circumferential direction of the cylindrical portion 40. An angle between a line connecting the center axis of the cylindrical portion 40 and the claw 42 and a line connecting the center axis of the cylindrical portion 40 and the claw 43 is approximately 150°, and an angle between the line connecting the center axis of the cylindrical portion 40 and the claw 42 and a line connecting the center axis of the cylindrical portion 40 and the claw 44 is approximately 150°. An angle between the line connecting the center axis of the cylindrical portion 40 and the claw 43 and the line connecting the center axis of the cylindrical portion 40 and the claw 44 is approximately 60°.

The claws 42-44 have a predetermined width along the outer periphery of the cylindrical portion 40 and the width is a little smaller than the width of the indentations 30-35. The claws 42-44 have a predetermined depth in a radial direction of the cylindrical portion 40 and the depth is a little smaller than the depth of the indentations 30-35 of the first and second coil members 10, 12. The claws 42-44 of this size can be inserted into the indentations 30-35 of the first and second coil members 10, 12 in the direction of the center axis of the cylindrical portion 40.

Figure 4B:
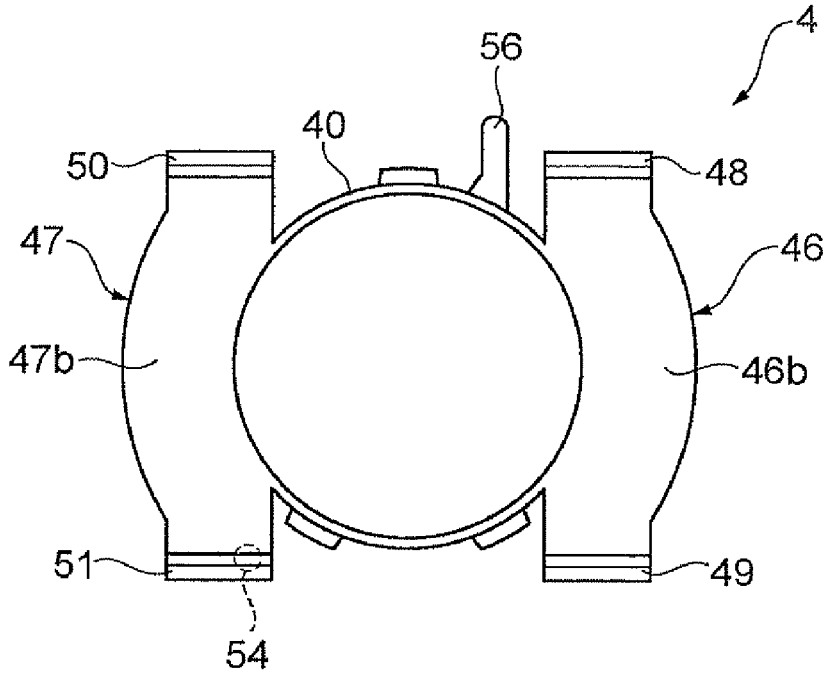
FIG. 4B is a bottom view of a coil bobbin in the coil component of FIG. 1.

Two flanges (insulating portions) 46, 47 for preventing contact between the coil winding and the core member 8 are provided in a protruding state at the other end of the cylindrical portion 40. The flanges 46, 47 protrude from the outer periphery of the cylindrical portion 40 in directions perpendicular to the center axis of the cylindrical portion 40 and are integrated with the cylindrical portion 40. The flanges 46, 47 have respective longitudinal directions and, when the coil bobbin 4 is viewed from the direction of the center axis of the cylindrical portion 40 as shown in FIG. 4A and FIG. 4B, the flange 46 and the flange 47 are apposed so that their longitudinal directions are parallel to each other and so that the cylindrical portion 40 is interposed between them. The flange 46 is joined to the outer peripheral surface of the cylindrical portion 40 located between the claw 42 and the claw 43 and the flange 47 is joined to the outer peripheral surface of the cylindrical portion 40 located between the claw 42 and the claw 44.

Fixing leg portions (legs) 48, 49 for engaging the coil bobbin 4 with the core member 8 are integrally provided at both opposed ends in the longitudinal direction of the flange 46. Furthermore, fixing leg portions (legs) 50, 51 for engaging the coil bobbin 4 with the core member 8 are also integrally provided at both opposed ends in the longitudinal direction of the flange 47.

Each of front and back faces 46*a*, 46*b* of the flange 46 spreading in directions perpendicular to the center axis of the cylindrical portion 40 is an almost flat surface. Each of front and back faces 47*a*, 47*b* of the flange 47 spreading in directions perpendicular to the center axis of the cylindrical portion 40 is also an almost flat surface. The front faces 46*a*, 47*a* are in contact with the back face 12*b* of the second coil member 12 and the back faces 46*b*, 47*b* are in contact with the core member 8 described below.

A corner 52 located on the claw 42 side in the flange 46 is chamfered. As the corner 52 is chamfered the coil bobbin 4 is prevented from being caught by the second coil member 12 during a coupling work between the coil winding 2 and the coil bobbin 4, and this permits the coupling work to be smoothly carried out.

A bobbin-side engagement portion 54 of a columnar shape is provided in a protruding state at a corner located on the claw 44 side in the flange 47. The bobbin-side engagement portion 54 protrudes from the front face 47*a* of the flange 47 and has such a size that it can be fitted in the depression of the winding-side engagement portion 36 of the second coil member 12.

A projection 56 for preventing contact between the first coil member 10 and the second coil member 12 is provided in a central region of the cylindrical portion 40. The projection 56 is of a prismatic shape and projects in a direction perpendicular to the center axis of the cylindrical portion 40 from the outer periphery of the cylindrical portion 40. The ridges of the projection 56 are chamfered so as not to damage the coil winding 2. For the same reason, the tip of the projection 56 is rounded. When viewed from a direction perpendicular to the center axis of the cylindrical portion 40 (cf. FIG. 1), a distance between the projection 56 and the claws 42-44 and a distance between the projection 56 and the flanges 46, 47 are larger than the respective thicknesses of the first and second coil members 10, 12. When viewed from the direction of the center axis of the cylindrical portion 40, the projection 56 is located between the claw 42 and the flange 46 and extends in parallel with the claw 42. When viewed from the direction of the center axis of the cylindrical portion 40, a distance between the claw 42 and the projection 56 is approximately equal to a distance between the indentations 30, 33 of the first and second coil members 10, 12 and the slit 22 of the second coil member 12 (cf. FIG. 2A and FIG. 2B).

When the coil bobbin 4 having the above configuration is viewed from the direction of the center axis of the cylindrical portion 40, there is no overlap among the cylindrical portion 40, the claws 42-44, the projection 56, and the flanges 46, 47, as shown in FIG. 4A and FIG. 4B. For this reason, the coil bobbin 4 can be readily manufactured by injection molding of an insulating resin with a die.

As shown in FIG. 1, a pair of core members 6, 8 are arranged relative to the coil bobbin 4 with the coil winding 2 thereon so that the cylindrical portion 40 is sandwiched between them from both ends thereof. In a state in which the cylindrical portion is sandwiched between the pair of core members 6, 8, the first and second terminal portions 24, 26 and the fixing legs 48-51 protrude from the core members 6, 8 (cf. FIG. 9).

The core members 6, 8 are so-called E-type cores obtained by compacting of ferrite powder. More specifically, the core member 6 consists of a base 60 of a flat plate shape having a longitudinal direction, a magnetic core 62 of a columnar shape protruding in the center of one principal face of the base 60, and legs 64, 66 protruding at both ends of the base 60. The core member 8 consists of a base 70 of a flat plate shape having a longitudinal direction, a magnetic core 72 of a columnar shape protruding in the center of one principal face of the base 70, and legs 74, 76 protruding at both ends of the base 70.

The magnetic core 62 of the core member 6 is inserted into the cylindrical portion 40 from the one end side of the cylindrical portion 40 of the coil bobbin 4 and the magnetic core 72 of the core member 8 is inserted into the cylindrical portion 40 from the other end side of the cylindrical portion 40 of the coil bobbin 4. The magnetic core 62 and the magnetic core 72 come into contact with each other in the cylindrical portion 40 of the coil bobbin 4. In a state in which the magnetic cores 62, 72 are inserted in the cylindrical portion 40, the legs 64, 66 of the core member 6 are also in contact with the legs 74, 76 of the core member 8.

The one principal face of the base 60 of the core member 6 comes into contact with the claws 42-44 of the coil bobbin 4. The one principal face of the base 70 of the core member 8 comes into contact with the back faces 46*b*, 47*b* of the flanges 46, 47 of the coil bobbin 4. The fixing legs 48-51 of the coil bobbin 4 are made engaged with a pair of side faces 70*b*, 70*c* extending along the longitudinal direction and perpendicularly to the one principal face in the base 70. The core member 6 and the core member 8 are coupled by adhesive tapes 80, 82.

The below will describe a method of assembling the coil component 1. FIGS. 5A to 8B are drawings showing assembling steps of the coil component 1. FIG. 5A, FIG. 6A, FIG. 7A, and FIG. 8A are views where the coil component 1 is viewed from the front face 10*a* side of the first coil member 10, and FIG. 5B, FIG. 6B, FIG. 7B, and FIG. 8B views where the coil component 1 is viewed from the back face 12*b* side of the second coil member 12.

Figure 5A:
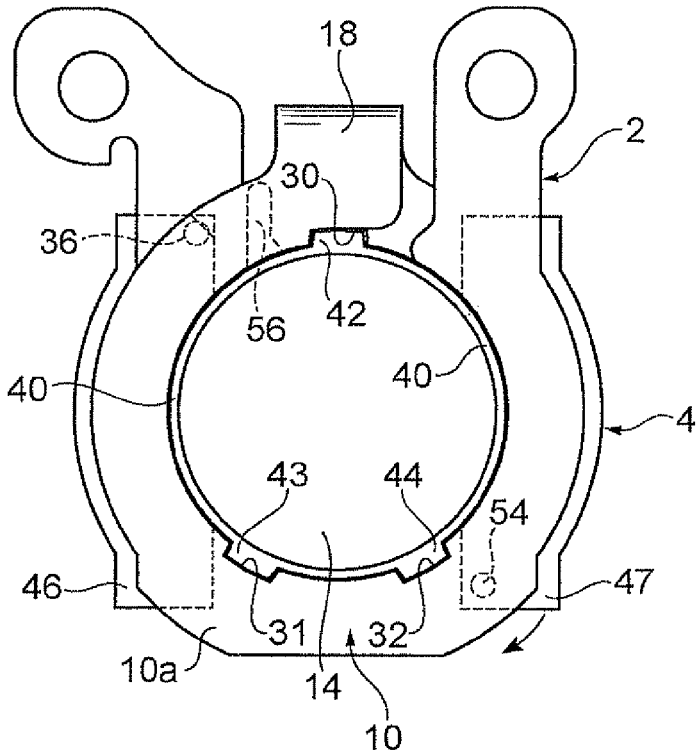
FIG. 5A is a drawing showing an assembling step of the coil component 1 of FIG. 1.
Figure 5B:
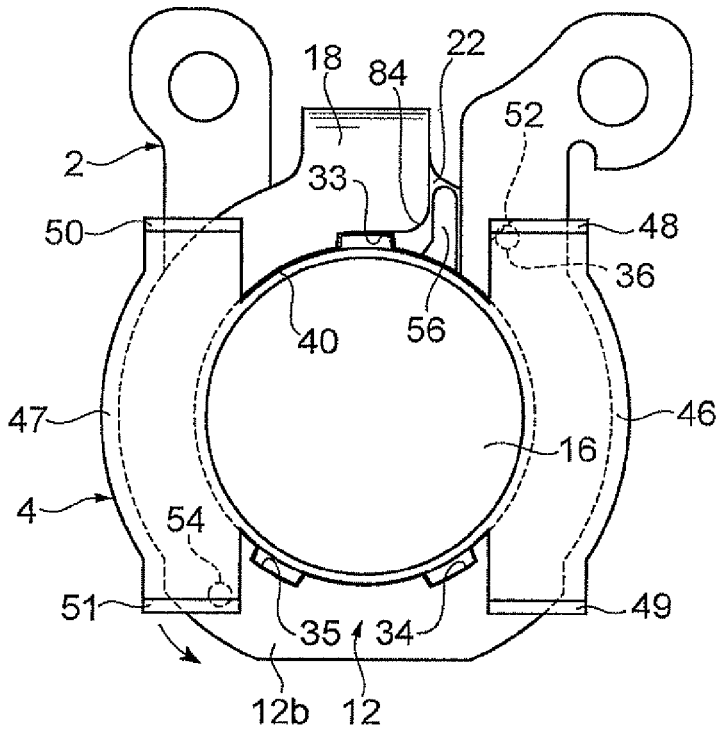
FIG. 5B is a drawing showing an assembling step of the coil component 1 of FIG. 1.

First, the cylindrical portion 40 of the coil bobbin 4 is inserted into the inside of the coil winding 2. FIG. 5A and FIG. 5B are drawings showing a state in which the cylindrical portion 40 of the coil bobbin 4 is inserted in the coil winding 2.

More specifically, the back face 12*b* of the second coil member 12 is opposed to one end face of the coil bobbin 4. Then the position of the claw 42 of the coil bobbin 4 is aligned with the indentations 30, 33 of the first and second coil members 10, 12. When these are aligned, the claw 43 is aligned with the indentations 31, 34 and the claw 44 is aligned with the indentations 32, 35. Furthermore, the projection 56 of the coil bobbin 4 is also aligned with the slit 22 of the second coil member 12. After the alignment, the coil winding 2 and the coil bobbin 4 are moved relative to each other, to bring the cylindrical portion 40 of the coil bobbin 4 into the openings 14, 16 of the first and second coil members 10, 12 in the direction of the center axis of the cylindrical portion 40. As the cylindrical portion 40 is inserted into the openings, the claws 42-44 come into the indentations 30-35 and the projection 56 comes into the slit 22.

As the cylindrical portion 40 is inserted, the flanges 46, 47 of the coil bobbin 4 come into contact with the back face 12*b* of the second coil member 12. This makes further insertion of the coil bobbin 4 impossible. In this state, the claws 42-44 of the coil bobbin 4 slightly protrude from the indentations 30-32 of the first coil member 10. The projection 56 is located between the first coil member 10 and the second coil member 12.

Figure 6A:
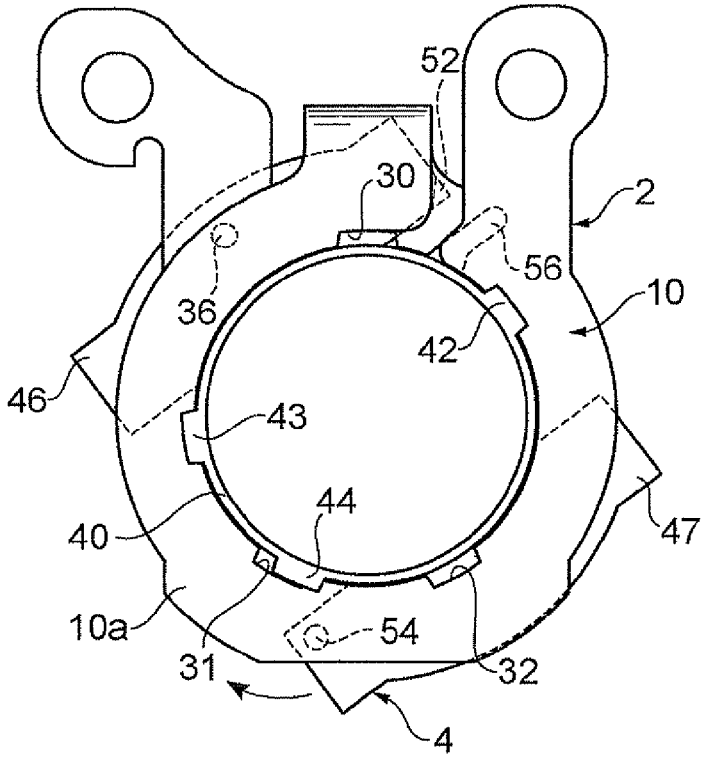
FIG. 6A is a drawing showing an assembling step of the coil component 1 of FIG. 1.
Figure 6B:
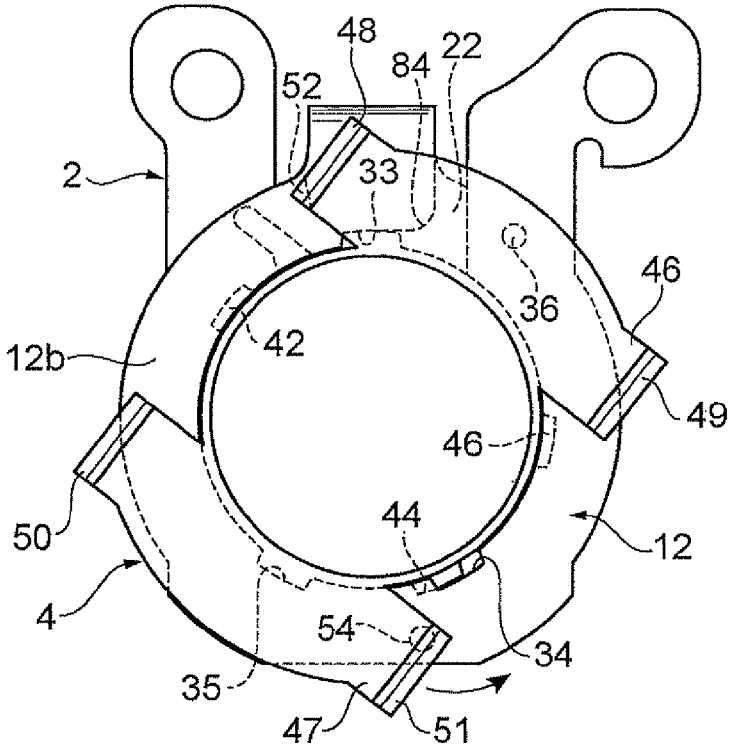
FIG. 6B is a drawing showing an assembling step of the coil component 1 of FIG. 1.

Next, the coil bobbin 4 is rotated relative to the coil winding 2. FIG. 6A and FIG. 6B are drawings showing a state in which the coil bobbin 4 is rotated by about 60° relative to the coil winding 2.

More specifically, while holding the fixing legs 48-51 of the coil bobbin 4, the coil bobbin 4 is rotated clockwise when viewed from the front face 10*a* of the first coil member 10. With a start of the rotation, the claw 42 of the coil bobbin 4 is disengaged from the indentation 30 of the first coil member 10 and the corner 52 of the flange 46 of the coil bobbin 4 comes into contact with a corner 84 beside the slit 22 in the second coil member 12. Since the corner 52 of the flange 46 is chamfered, the corner 52 of the flange 46 is not caught by the corner 84 of the second coil member 12, so as to achieve smooth rotation. For achieving smoother rotation, the corner 84 of the second coil member 12 is also preferably rounded as shown in FIG. 6B.

When the coil bobbin 4 is rotated from the state of FIG. 5A and FIG. 5B clockwise as viewed from the front face 10*a* of the first coil member 10, the claw 43 of the coil bobbin 4 is disengaged from the indentation 31 of the first coil member 10 and the claw 44 of the coil bobbin 4 is disengaged from the indentation 32 of the first coil member 10. With further rotation, the claw 44 of the coil bobbin 4 becomes fitted in the indentation 31 of the first coil member 10.

When the coil bobbin 4 is rotated from the state of FIG. 5A and FIG. 5B clockwise as viewed from the front face 10*a* of the first coil member 10, the projection 56 of the coil bobbin 4 comes into the space between the first coil member 10 and the second coil member 12 to prevent contact between the first coil member 10 and the second coil member 12.

If the coil bobbin 4 is rotated from the state of FIG. 5A and FIG. 5B in the opposite direction (i.e., counterclockwise when viewed from the front face 10*a* of the first coil member 10), the projection 56 of the coil bobbin 4 will soon come into contact with the winding-side engagement portion 36 of the second coil member 12 to hinder rotation of the coil bobbin 4. In this way the winding-side engagement portion 36 functions to prevent the rotation in the opposite direction of the coil bobbin 4.

Figure 7A:
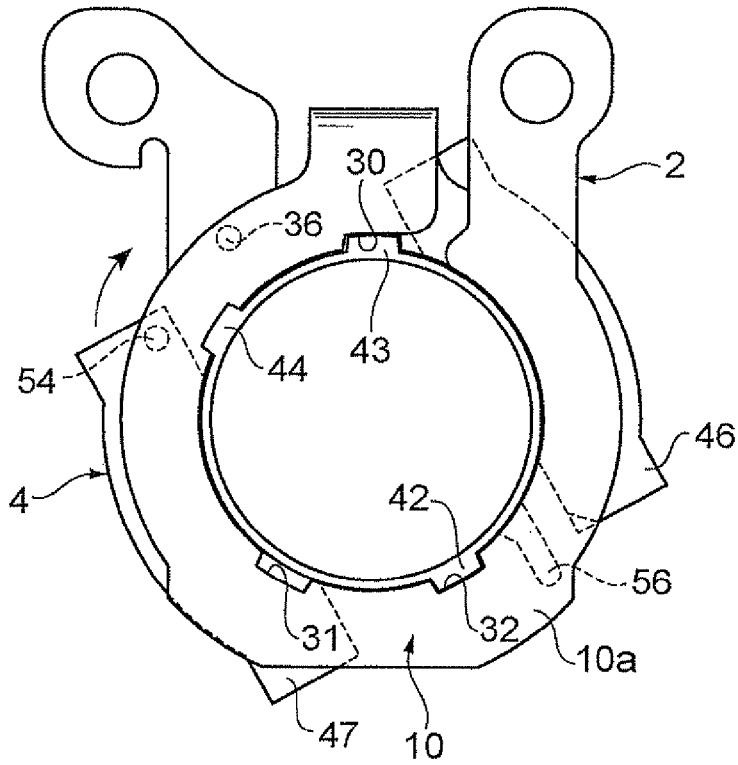
FIG. 7A is a drawing showing an assembling step of the coil component 1 of FIG. 1.
Figure 7B:
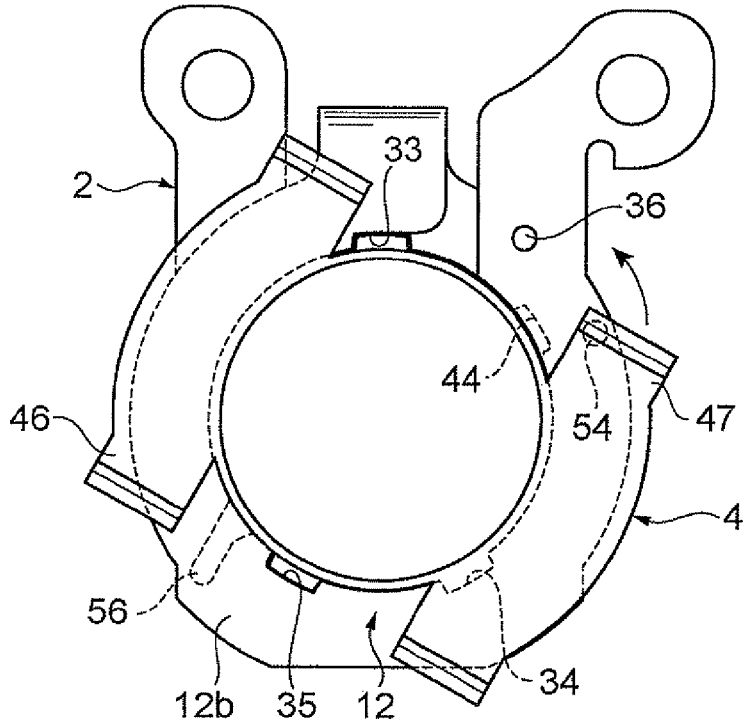
FIG. 7B is a drawing showing an assembling step of the coil component 1 of FIG. 1.

Next, the coil bobbin 4 at the position in FIG. 6A and FIG. 6B is further rotated. FIG. 7A and FIG. 7B are drawings showing a state in which the coil bobbin 4 is further rotated by about 60° from the state of FIG. 6A and FIG. 6B.

More specifically, while holding the fixing legs 48-51 of the coil bobbin 4, the coil bobbin 4 is further rotated clockwise when viewed from the front face 10*a* of the first coil member 10. Then the claw 42 of the coil bobbin 4 becomes fitted in the indentation 32 of the first coil member 10. Furthermore, the claw 43 of the coil bobbin 4 becomes fitted in the indentation 30 of the first coil member 10 and the claw 44 of the coil bobbin 4 becomes disengaged from the indentation 31 of the first coil member 10.

Figure 8A:
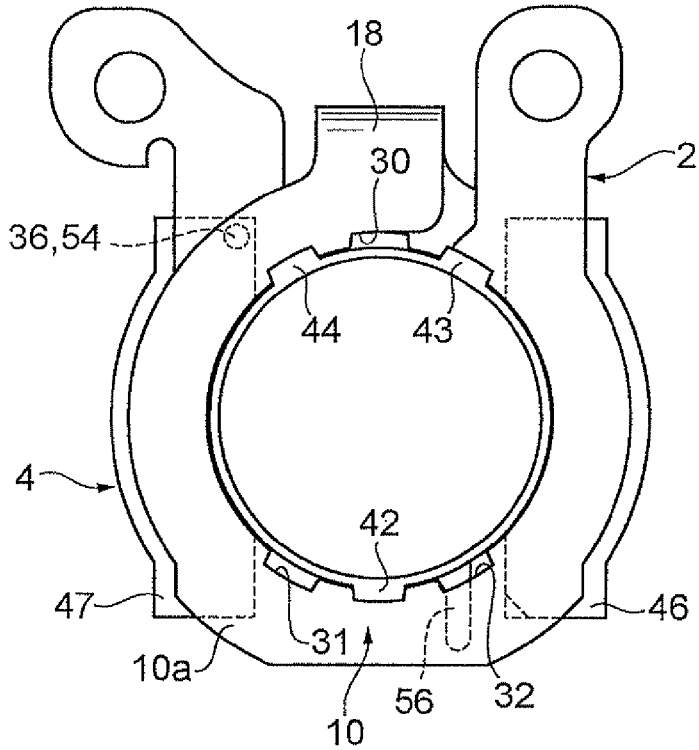
FIG. 8A is a drawing showing an assembling step of the coil component 1 of FIG. 1.
Figure 8B:
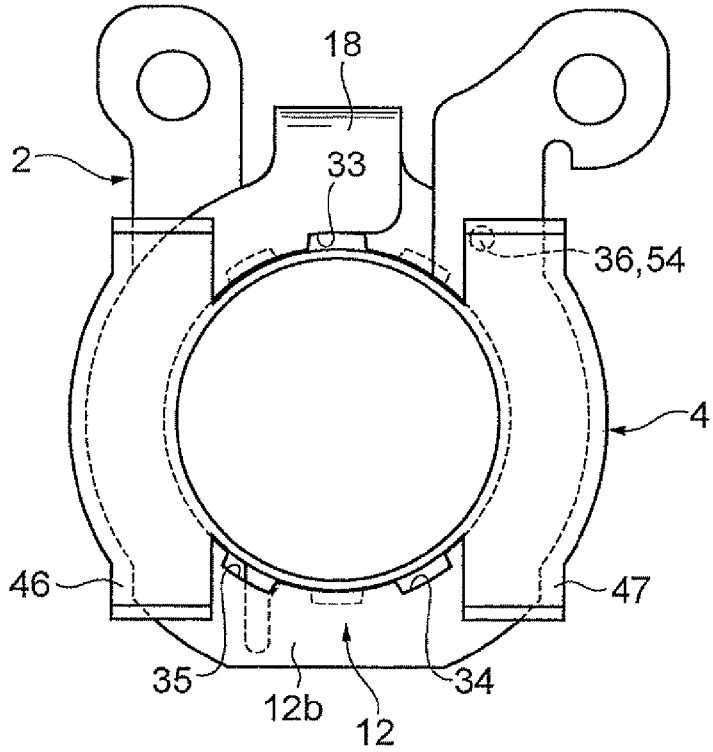
FIG. 8B is a drawing showing an assembling step of the coil component 1 of FIG. 1.

Thereafter, the coil bobbin 4 at the position in FIG. 7A and FIG. 7B is further rotated. FIG. 8A and FIG. 8B are drawings showing a state in which the coil bobbin 4 is further rotated by about 30° from the state of FIG. 7A and FIG. 7B.

More specifically, while holding the fixing legs 48-51 of the coil bobbin 4, the coil bobbin 4 is further rotated clockwise when viewed from the front face 10*a* of the first coil member 10. Then the claw 42 of the coil bobbin 4 becomes disengaged from the indentation 32 of the first coil member 10. Furthermore, the claw 43 of the coil bobbin 4 becomes disengaged from the indentation 30 of the first coil member 10. As the coil bobbin 4 is further rotated from this state, the projecting bobbin-side engagement portion 54 of the coil bobbin 4 becomes fitted in the depression of the winding-side engagement portion 36 of the second coil member 12. This makes the coil bobbin 4 and the coil winding 2 positioned relative to each other. At this time, when viewed from the front face 10*a* side of the first coil member 10, the claw 42 of the coil bobbin 4 is located between the indentations 31, 32 of the first coil member 10, as shown in FIG. 8A. Furthermore, the claws 43, 44 of the coil bobbin 4 are located so as to sandwich the indentation 30 of the first coil member 10 in between. Therefore, the coil winding 2 becomes sandwiched between the claws 42-44 and the flanges 46, 47 of the coil bobbin 4. The projection 56 of the coil bobbin 4 is located almost opposite to the joint 18. In the first and second coil members 10, 12, the portions apart from the joint 18 are easily bent by vibration or the like. When the projection 56 is interposed between such portions, it can securely prevent contact between the first coil member 10 and the second coil member 12.

The above steps complete coupling between the coil bobbin 4 and the coil winding 2.

Figure 9:
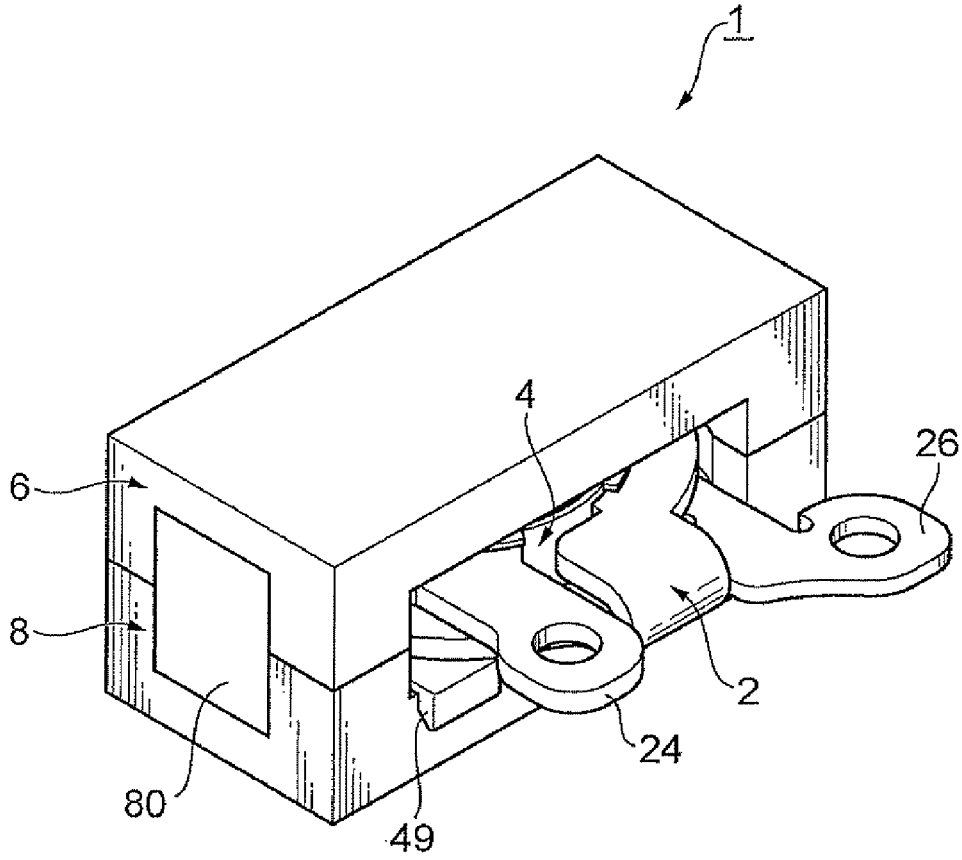
FIG. 9 is a perspective view of the coil component 1 of FIG. 1.

Next, the coil bobbin 4 and the coil winding 2 thus coupled are sandwiched between the pair of core members 6, 8 in the direction of the center axis of the cylindrical portion 40. By this, the magnetic cores 62, 72 of the core members 6, 8 become inserted in the cylindrical portion 40 of the coil bobbin 4, the legs 64, 66 of the core member 6 come into contact with the legs 74, 76 of the core member 8, and the fixing legs 48-51 of the coil bobbin 4 become engaged with the side faces 70*b*, 70*c* of the base 70 of the core member 8. Furthermore, the one principal face of the base 60 of the core member 6 comes into contact with the claws 42-44 of the coil bobbin 4 and the one principal face of the base 70 of the core member 8 comes into contact with the back faces 46*b*, 47*b* of the flanges 46, 47 of the coil bobbin 4. Thereafter, the legs 64, 66 of the core member 6 and the legs 74, 76 of the core member 8 are secured with adhesive tapes 80, 82, thereby completing the coil component 1 as shown in FIG. 9.

In the case of the coil component 1 having the above configuration, the cylindrical portion 40 of the coil bobbin 4 is inserted into the openings 14, 16 of the first and second coil members 10, 12 in such a manner that the claws 42-44 of the coil bobbin 4 pass through the indentations 30-35 of the first and second coil members 10, 12. Then the claws 42-44 are made protruding from the first coil member 10 and thereafter the cylindrical portion 40 of the coil bobbin 4 is rotated relative to the coil winding 2. This makes the claws 42-44 disengaged from the indentations 30-35 and the coil winding 2 becomes sandwiched between the claws 42-44 and the flanges 46, 47. As a consequence, the claws 42-44 are interposed between the core member 6 and the coil winding 2 and the flanges 46, 47 are interposed between the core member 8 and the coil winding 2; therefore, the core members 6, 8 become less likely to contact the coil winding 2. Accordingly, the electrical insulation of the coil winding 2 can be improved without increase in the number of parts.

In the coil component 1, the three claws 42-44 of the coil bobbin 4 are provided in a mutually separated state. When a plurality of claws are provided in a mutually separated state, the contact between the coil winding 2 and the core members 6, 8 is more certainly prevented, whereby the electrical insulation of the coil winding 2 can be surely improved.

The projection 56 projecting outwardly relative to the center axis of the cylindrical portion 40 is provided between one end and the other end of the cylindrical portion 40 of the coil bobbin 4. When the claws 42-44 of the coil bobbin 4 are made to pass through the indentations 30-35 of the first and second coil members 10, 12, the projection 56 is made to pass through the slit 22 of the second coil member 12. Thereafter, the cylindrical portion 40 is rotated relative to the coil winding 2, whereby the projection 56 is brought through the slit 22 into the space between the first coil member 10 and the second coil member 12. The projection 56 interposed between the first coil member 10 and the second coil member 12 prevents contact between the first coil member 10 and the second coil member 12, which can prevent the coil members from contacting each other to short-circuit. The projection 56 interposed between the first coil member 10 and the second coil member 12 suppresses movement of the coil bobbin 4 in the center axis direction of the cylindrical portion 40, which can reduce unsteadiness between the coil bobbin 4 and the coil winding 2.

In the coil component 1, the projecting bobbin-side engagement portion 54 of the coil bobbin 4 becomes fitted in the depression of the winding-side engagement portion 36 of the second coil member 12. This suppresses rotation of the coil members and also suppresses positional deviation of the coil winding 2 relative to the coil bobbin 4 in radial directions of the cylindrical portion 40, so as to restrain unsteadiness of the coil winding 2.

In the coil component 1, the winding-side engagement portion 36 of the second coil member 12 is projecting toward the first coil member 10. This winding-side engagement portion 36 is provided at the other end of the second coil member 12, i.e., beside the slit 22. For this reason, when the projection 56 of the coil bobbin 4 is inserted into the slit 22 and the coil bobbin 4 is rotated backward against the expected direction, the projection 56 comes into contact with the winding-side engagement portion 36 to hinder rotation of the coil bobbin 4. Therefore, the rotation direction of the coil bobbin 4 is uniquely determined, whereby the coil bobbin 4 and the coil winding 2 can be securely and correctly coupled.

In the coil component 1, the winding-side engagement portion 36 is of the cylindrical shape with a bottom. If the winding-side engagement portion 36 is of a cylindrical shape without a bottom, the second coil member 12 will have a hole, so as to increase the electrical resistance of the second coil member 12. When the winding-side engagement portion 36 has the bottom as in the present embodiment, it can prevent the increase in electrical resistance of the second coil member 12.

In the coil component 1 the fixing legs 48-51 protrude from the flanges 46, 47, and the fixing legs 48-51 are made engaged with the side faces 70*b*, 70*c* of the core member 8. This engagement suppresses positional deviation of the coil bobbin 4 relative to the core member 8 and thus can suppress unsteadiness of the coil bobbin 4.

Second Embodiment

Figure 10:
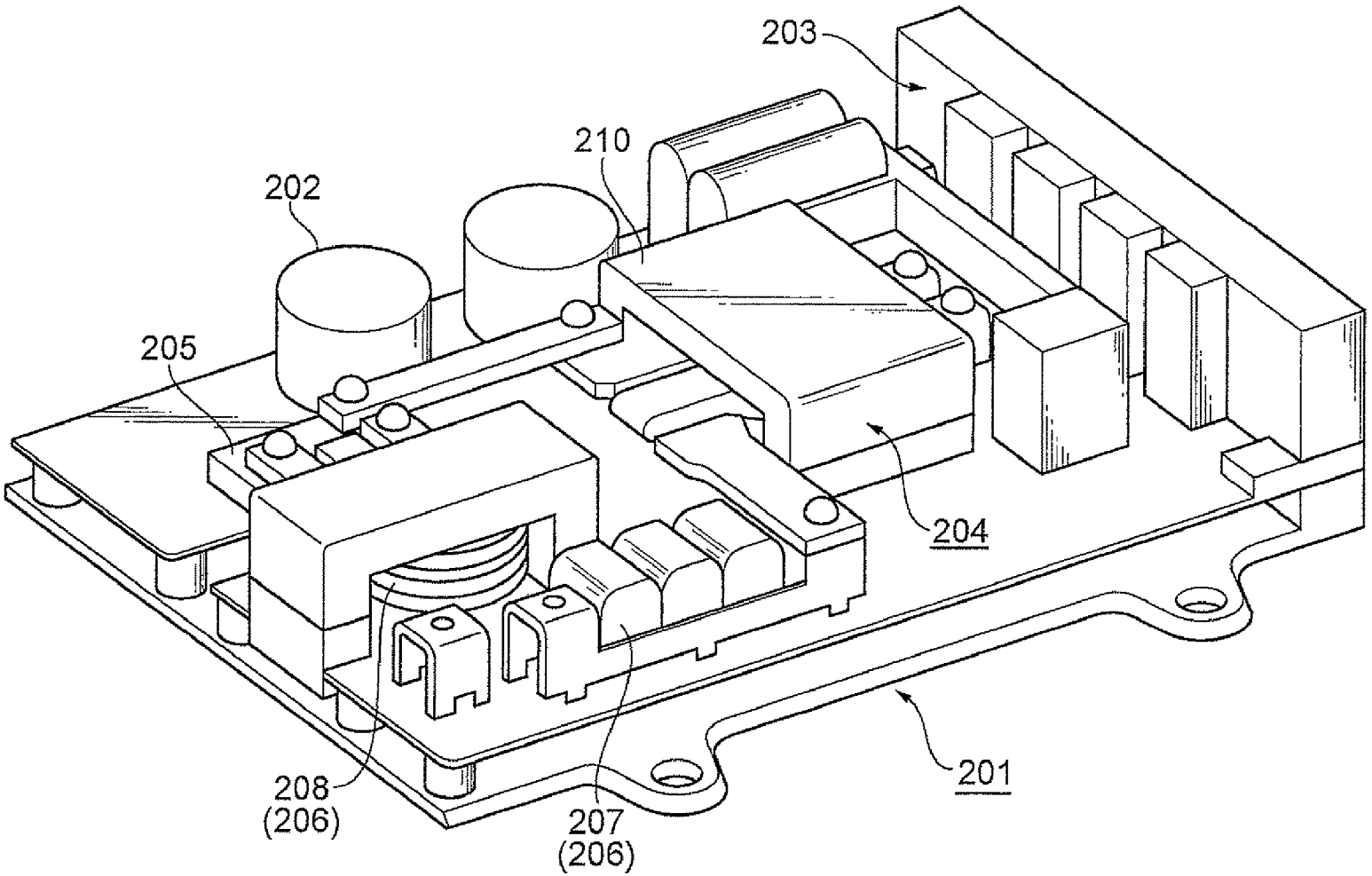
FIG. 10 is a perspective view showing an embodiment of the DC-DC converter according to the present invention.

The below will describe a DC-DC converter according to the second embodiment of the present invention. FIG. 10 is a perspective view of DC-DC converter 201 according to the present embodiment.

The DC-DC converter 201 shown in FIG. 10 is one to be mounted on an automobile, and is provided with an input smoothing circuit 202, an inverter circuit 203, a transformer 204, a full-wave rectifier circuit module 205, and an output smoothing circuit 206.

The input smoothing circuit 202 is connected to a DC power supply (not shown) being an automobile battery and is configured to smooth an electric power supplied from the DC power supply and to output the smoothed power. The inverter circuit 203 is connected to the input smoothing circuit 202 and converts the smoothed DC power supplied from the input smoothing circuit 202, into an AC power.

The transformer 204 is connected to the inverter circuit 203 and adjusts the output power of the inverter circuit 203. The transformer 204 has a coil bobbin around which a primary coil winding is wound and a coil bobbin around which a secondary coil winding is wound, and the coil bobbin 4 and coil winding 2 described in the first embodiment are used for at least one coil bobbin and coil winding wound around it.

The full-wave rectifier circuit module 205 is connected to the transformer 204 and rectifies the output power from the transformer 204. The output smoothing circuit 206 is connected to the full-wave rectifier circuit module 205 and smoothes the output power from the full-wave rectifier circuit module 205. The output smoothing circuit 206 has a smoothing capacitor 207 and a choke coil 208 and further has a controller (not shown) for controlling the inverter circuit 203, and an electric current sensor (not shown).

As described above, the DC-DC converter 201 of the present embodiment has the transformer 204 and this transformer 204 has the coil winding 2 and coil bobbin 4 described in the first embodiment. Therefore, we can obtain the transformer 204 with improved electrical insulation of the coil winding and with reduced unsteadiness of the coil bobbin 4 and the coil winding 2 and, in turn, we can obtain the DC-DC converter 201 with improved electrical insulation of the coil winding and with reduced unsteadiness of the coil bobbin 4 and the coil winding 2.

In the DC-DC converter 201 to be mounted on an automobile, if electrical insulation of the coil winding used in the transformer 204 is insufficient, contact between coil windings or contact between the coil winding and the core members can be caused by vibration of an engine or shakes during driving, so as to result in a short circuit. This problem can be solved by increasing the distances between the coil windings and between the coil winding and the core members, but in that case, the sizes of the transformer 204 and the DC-DC converter 201 become larger, so as to lead to a failure in downsizing. When the coil winding 2 and coil bobbin 4 described in the first embodiment are used in the transformer 204, contact is prevented between the first coil member 10 and the second coil member 12 forming the coil winding 2 and contact is also prevented between the coil winding 2 and a member 210 covering the coil winding 2. It also makes unsteadiness less likely to occur between the coil bobbin 4 and the coil winding 2 with vibration. Accordingly, we can obtain the compact transformer 204 and DC-DC converter 201 with little malfunction due to vibration and shakes.

The above described the preferred embodiments of the present invention, and it should be noted that the present invention is by no means intended to be limited to the above embodiments.

For example, the winding-side engagement portion 36 of the second coil member 12 may be one of a cylindrical shape opened at both ends. The winding-side engagement portion 36 may be a through hole penetrating the second coil member 12 in its thickness direction.

Furthermore, the winding-side engagement portion 36 may be one protruding outwardly from the back face 12*b* of the second coil member 12. Namely, the winding-side engagement portion 36 may be one of a projecting shape on the back face 12*b*. In this case, for achieving engagement between the winding-side engagement portion 36 and the bobbin-side engagement portion 54 of the coil bobbin 4, the bobbin-side engagement portion 54 needs to be depressed in the front face 47*a*. More specifically, the bobbin-side engagement portion 54 needs to be depressed from the front face 47*a* to the back face 47*b* of the flange 47.

The winding-side engagement portion 36 does not have to protrude from the front face 12*a* of the second coil member 12 toward the first coil member 10. In this case, however, in order to prevent the reverse rotation of the coil bobbin 4, it is preferable to provide the second coil member 12 with a projection protruding from the front face 12*a*.

The projection 56 of the coil bobbin 4 is intended to pass through the slit 22 of the coil member 12, but it can also be contemplated that another slit extending from the inner periphery to the outer periphery is provided in the coil member 12 and the projection 56 is made to pass through this slit.

The angles of the indentations 30-32 in the first coil member 10 are not limited to those described in the first embodiment. All the angles may be made equal to each other or different from each other. For example, in a case where the indentations are arranged at respective positions without rotational symmetry, all the indentations 30-35 of the coil winding 2 and the claws 42-44 of the coil bobbin 4 will never come to coincide again with each other on the way of mounting the coil bobbin 4 onto the coil winding 2, and this configuration facilitates mounting. The angles of the indentations 33-35 and the claws 42-44 are assumed to correspond to the angles of the indentations 30-32.

The number of indentations in each of the first and second coil members 10, 12 is not limited to that in the first embodiment. The number may be one or two, or may be four or more. However, an increase in the number of indentations makes it difficult to secure the cross-sectional area of the first and second coil members 10, 12 by that degree. Particularly preferably, the number of indentations is three as in the first embodiment, because the indentations can be located at effective positions (i.e., two at the positions apart from the joint 18 and one near the joint 18 in the coil winding 2) while securing the cross-sectional area.

The core members 6, 8 do not have to be provided with the magnetic cores 62, 72. In this case, the core members 6, 8 are so-called U-type cores and the coil winding 2 is a hollow coil. Besides, the core members 6, 8 may be a combination of an E-type core for one and an I-type core for the other, or a combination of a U-type core for one and an I-type core for the other.

The number of coil members of the coil winding 2 may be two or more.

Figure 11:
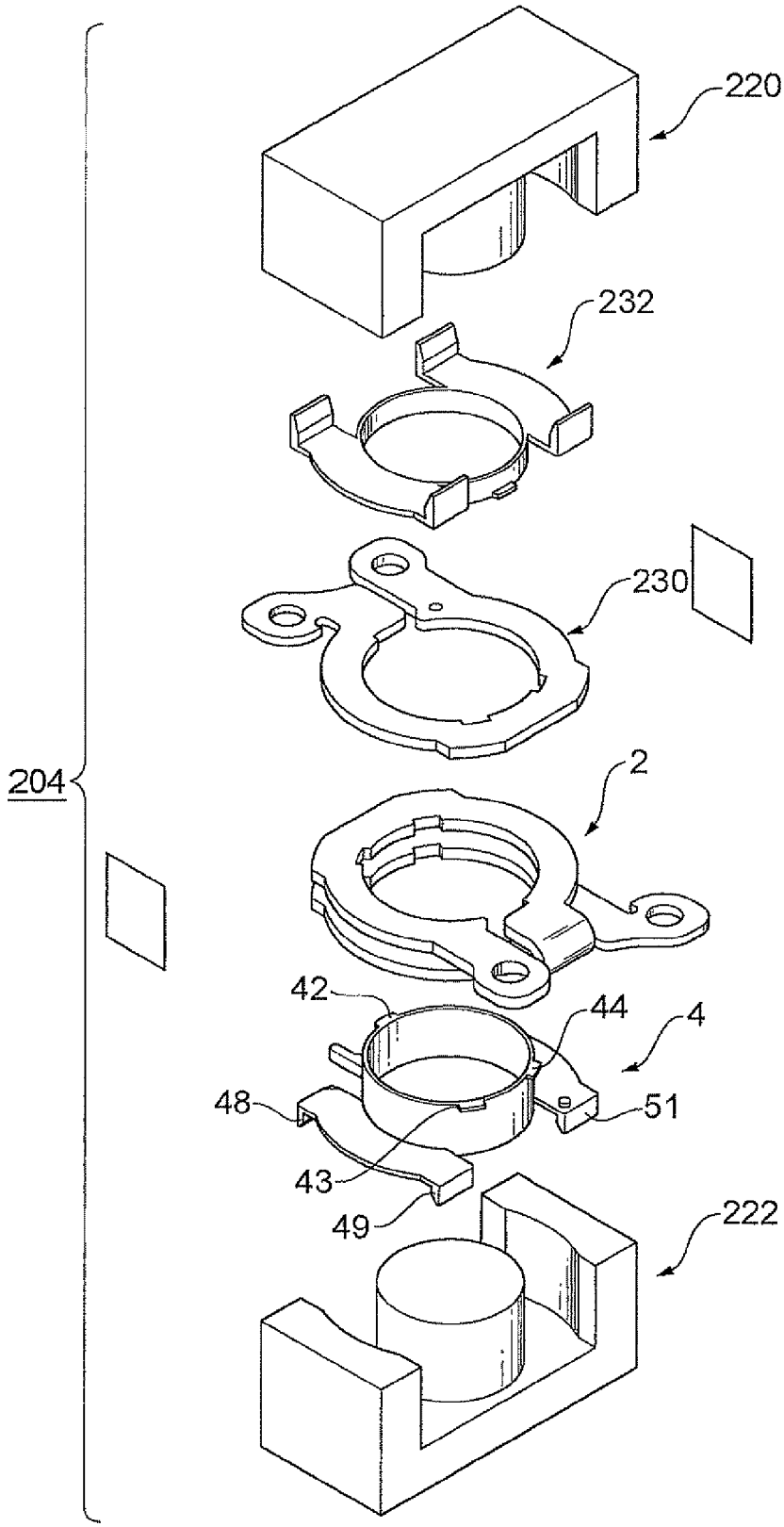
FIG. 11 is an exploded perspective view showing a modification example of a transformer in the DC-DC converter of FIG. 10.

The configurations of the transformer 204 and DC-DC converter 201 are not limited to those in FIG. 10. Concerning the transformer 204, it may have, for example, a configuration as shown in FIG. 11. Namely, the transformer has the configuration wherein the coil bobbin 4 with the coil winding 2 thereon and a coil bobbin 232 with a coil winding 230 thereon are interposed between a pair of core members 220, 222. The coil winding 230 is one wherein terminal portions are provided at both ends of a C-shaped coil member, and has three indentations as the first coil member 10 and the second coil member 12 of the coil winding 2 do. The coil bobbin 232 has a cylindrical portion shorter than the cylindrical portion 40 of the coil bobbin 4 but has no portion corresponding to the projection 56. In this case, the coil bobbin 232 and the coil bobbin 4 are preferably arranged so that their edges with claws are opposed to each other. This arrangement allows the claws to keep the coil winding 230 and the coil winding 2 in no contact, and secures the fixing legs of the coil bobbin 232 to one core member 220 and the fixing legs 48-51 of the coil bobbin 4 to the other core member 222.

In the DC-DC converter 201, use of the coil winding 2 and coil bobbin 4 described in the first embodiment is not limited only to the transformer 204. For example, they may be used in the choke coil 208 of the output smoothing circuit 206.

What is claimed is:

1. An electrically conductive coil winding to be wound around a cylindrical portion of an electrically insulating coil bobbin, wherein the coil winding is comprised of a plurality of coil members of an end-defined ring shape coupled so as to be continuous in a predetermined winding direction, wherein the cylindrical portion is to be inserted into openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion to be opposed to the coil member, the bobbin-side engagement portion being a first projection, wherein a winding-side engagement portion is provided on the coil member into which the cylindrical portion is first to be inserted, the winding-side engagement portion comprising a second projection and a depression, the second projection being provided on a face to be opposed to the insulating portion, the depression being provided on a reverse face of the face to be opposed to the insulating portion, the depression being engageable with the bobbin-side engagement portion, wherein a third projection of the coil bobbin comes into contact with the second projection of the winding-side engagement portion before the depression of the winding-side engagement portion engages with the bobbin-side engagement portion when the third projection is inserted into a slit and the coil bobbin is rotated in a second direction opposite to a first direction, wherein the third projection protruding outwardly relative to the center axis is provided on an outer peripheral surface between the one end and the other end of the cylindrical portion, wherein the coil member into which the cylindrical portion is first to be inserted, has a projection insertion portion extending from an inner periphery to an outer periphery thereof, the projection insertion portion being the slit between one end and the other end of the coil member, wherein the third projection is made to pass through the projection insertion portion during insertion of the cylindrical portion into the openings of the coil members, and wherein after the insertion of the cylindrical portion, the cylindrical portion is to be rotated in the first direction relative to the coil winding so that the third projection moves from one end toward the other end of the coil member, into which the cylindrical portion is first to be inserted, along the coil member whereby the third projection is located between the coil members and whereby the winding-side engagement portion comes into engagement with the bobbin-side engagement portion.

2. A coil component comprising an electrically insulating coil bobbin having a cylindrical portion, and an electrically conductive coil winding wound around the cylindrical portion, wherein the coil winding is comprised of a plurality of coil members of an end-defined ring shape coupled so as to be continuous in a predetermined winding direction, wherein the cylindrical portion is inserted in openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion opposed to the coil member, the bobbin-side engagement portion being a first projection, wherein a winding-side engagement portion is provided on the coil member into which the cylindrical portion is first to be inserted, the winding-side engagement portion comprising a second projection and a depression, the second projection being provided on a face to be opposed to the insulating portion, the depression being provided on a reverse face of the face to be opposed to the insulating portion, the depression being engageable with the bobbin-side engagement portion, wherein a third projection of the coil bobbin comes into contact with the second projection of the winding-side engagement portion before the depression of the winding-side engagement portion engages with the bobbin-side engagement portion when the third projection is inserted into a slit and the coil bobbin is rotated in a second direction opposite to a first direction, wherein the third projection protruding outwardly relative to the center axis is provided on an outer peripheral surface between the one end and the other end of the cylindrical portion, wherein the coil member into which the cylindrical portion is first to be inserted, has a projection insertion portion extending from an inner periphery to an outer periphery thereof, the projection insertion portion being the slit between one end and the other end of the coil member, wherein the cylindrical portion is to be inserted into the openings of the coil members so that the third projection passes through the projection insertion portion, and wherein after the insertion of the cylindrical portion, the cylindrical portion is to be rotated in the first direction relative to the coil winding so that the third projection moves from one end toward the other end of the coil member, into which the cylindrical portion is first to be inserted, along the coil member whereby the third projection is located between the coil members and whereby the bobbin-side engagement portion comes into engagement with the winding-side engagement portion.

3. The coil component according to claim 2, wherein the coil bobbin is sandwiched between magnetic core members in the direction of the center axis, and wherein a leg for engaging the coil bobbin with the magnetic core member is provided in a projecting state on a face of the insulating portion opposite to the face opposed to the coil member.

4. The coil component according to claim 3, further comprising the magnetic core members.

5. A transformer comprising a coil component, the coil component comprising an electrically insulating coil bobbin having a cylindrical portion, and an electrically conductive coil winding wound around the cylindrical portion, wherein the coil winding is comprised of a plurality of coil members of an end-defined ring shape coupled so as to be continuous in a predetermined winding direction, wherein the cylindrical portion is inserted in openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion opposed to the coil member, and member, the bobbin-side engagement portion being a first projection, wherein a winding-side engagement portion engageable with the bobbin-side engagement portion is formed on a face opposed to the insulating portion, of is provided on the coil member into which the cylindrical portion is first to be inserted, inserted, the winding-side engagement portion comprising a second projection and a depression, the second projection being provided on a face to be opposed to the insulating portion, the depression being provided on a reverse face of the face to be opposed to the insulating portion, the depression being engageable with the bobbin-side engagement portion, wherein a third projection of the coil bobbin comes into contact with the second projection of the winding-side engagement portion before the depression of the winding-side engagement portion engages with the bobbin-side engagement portion when the third projection is inserted into a slit and the coil bobbin is rotated in a second direction opposite to a first direction, wherein the third projection protruding outwardly relative to the center axis is provided on an outer peripheral surface between the one end and the other end of the cylindrical portion, wherein the coil member into which the cylindrical portion is first to be inserted, has a projection insertion portion extending from an inner periphery to an outer periphery thereof, the projection insertion portion being the slit between one end and the other end of the coil member, wherein the cylindrical portion is to be inserted into the openings of the coil members so that the third projection passes through the projection insertion portion, and wherein after the insertion of the cylindrical portion, the cylindrical portion is to be rotated in the first direction relative to the coil winding so that the third projection moves from one end toward the other end of the coil member, into which the cylindrical portion is first to be inserted, along the coil member whereby the third projection is located between the coil members and whereby the bobbin-side engagement portion comes into engagement with the winding-side engagement portion.

6. A DC-DC converter comprising a transformer, the transformer comprising a coil component, the coil component comprising an electrically insulating coil bobbin having a cylindrical portion, and an electrically conductive coil winding wound around the cylindrical portion, wherein the coil winding is comprised of a plurality of coil members of an end-defined ring shape coupled so as to be continuous in a predetermined winding direction, wherein the cylindrical portion is inserted in openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion opposed to the coil member, and member, the bobbin-side engagement portion being a first projection, wherein a winding-side engagement portion engageable with the bobbin-side engagement portion is formed on a face opposed to the insulating portion, of is provided on the coil member into which the cylindrical portion is first to be inserted, inserted, the winding-side engagement portion comprising a second projection and a depression, the second projection being provided on a face to be opposed to the insulating portion, the depression being provided on a reverse face of the face to be opposed to the insulating portion, the depression being engageable with the bobbin-side engagement portion, wherein a third projection of the coil bobbin comes into contact with the second projection of the winding-side engagement portion before the depression of the winding-side engagement portion engages with the bobbin-side engagement portion when the third projection is inserted into a slit and the coil bobbin is rotated in a second direction opposite to a first direction, wherein the third projection protruding outwardly relative to the center axis is provided on an outer peripheral surface between the one end and the other end of the cylindrical portion, wherein the coil member into which the cylindrical portion is first to be inserted, has a projection insertion portion extending from an inner periphery to an outer periphery thereof, the projection insertion portion being the slit between one end and the other end of the coil member, wherein the cylindrical portion is to be inserted into the openings of the coil members so that the third projection passes through the projection insertion portion, and wherein after the insertion of the cylindrical portion, the cylindrical portion is to be rotated in the first direction relative to the coil winding so that the third projection moves from one end toward the other end of the coil member, into which the cylindrical portion is first to be inserted, along the coil member whereby the third projection is located between the coil members and whereby the bobbin-side engagement portion comes into engagement with the winding-side engagement portion.

7. A DC-DC converter comprising a coil component, the coil component comprising an electrically insulating coil bobbin having a cylindrical portion, and an electrically conductive coil winding wound around the cylindrical portion, wherein the coil winding is comprised of a plurality of coil members of an end-defined ring shape coupled so as to be continuous in a predetermined winding direction, wherein the cylindrical portion is inserted in openings of the coil members from one end of the cylindrical portion and along a direction of a center axis of the cylindrical portion, wherein an insulating portion protruding outwardly relative to the center axis is integrally provided at the other end of the cylindrical portion, and a bobbin-side engagement portion for engagement between the coil bobbin and the coil winding is formed on a face of the insulating portion opposed to the coil member, and member, the bobbin-side engagement portion being a first projection, wherein a winding-side engagement portion engageable with the bobbin-side engagement portion is formed on a face opposed to the insulating portion, of is provided on the coil member into which the cylindrical portion is first to be inserted, inserted, the winding-side engagement portion comprising a second projection and a depression, the second projection being provided on a face to be opposed to the insulating portion, the depression being provided on a reverse face of the face to be opposed to the insulating portion, the depression being engageable with the bobbin-side engagement portion, wherein a third projection of the coil bobbin comes into contact with the second projection of the winding-side engagement portion before the depression of the winding-side engagement portion engages with the bobbin-side engagement portion when the third projection is inserted into a slit and the coil bobbin is rotated in a second direction opposite to a first direction, wherein the third projection protruding outwardly relative to the center axis is provided on an outer peripheral surface between the one end and the other end of the cylindrical portion, wherein the coil member into which the cylindrical portion is first to be inserted, has a projection insertion portion extending from an inner periphery to an outer periphery thereof, the projection insertion portion being the slit between one end and the other end of the coil member, wherein the cylindrical portion is to be inserted into the openings of the coil members so that the third projection passes through the projection insertion portion, and wherein after the insertion of the cylindrical portion, the cylindrical portion is to be rotated in the first direction relative to the coil winding so that the third projection moves from one end toward the other end of the coil member, into which the cylindrical portion is first to be inserted, along the coil member whereby the third projection is located between the coil members and whereby the bobbin-side engagement portion comes into engagement with the winding-side engagement portion.

* * * * *